US008302638B2

(12) United States Patent
Bentivoglio

(10) Patent No.: US 8,302,638 B2
(45) Date of Patent: Nov. 6, 2012

(54) ELECTROMECHANICALLY OPERATED FUEL NOZZLE

(75) Inventor: Galliano Bentivoglio, Bologna (IT)

(73) Assignee: Nozzle Eng. S.R.L., Saronno (IT)

( * ) Notice: Subject to any disclaimer, the term of this patent is extended or adjusted under 35 U.S.C. 154(b) by 736 days.

(21) Appl. No.: 12/306,087

(22) PCT Filed: Jun. 20, 2007

(86) PCT No.: PCT/IB2007/052379

§ 371 (c)(1),
(2), (4) Date: Sep. 1, 2009

(87) PCT Pub. No.: WO2007/148295

PCT Pub. Date: Dec. 27, 2007

(65) Prior Publication Data

US 2010/0000629 A1 Jan. 7, 2010

(30) Foreign Application Priority Data

Jun. 21, 2006 (IT) ..... MO2006A0202

(51) Int. Cl.
*B67C 3/00* (2006.01)

(52) U.S. Cl. ..... 141/219; 141/206; 141/217; 141/228

(58) Field of Classification Search ..... 141/59, 141/206–229; 222/59, 61
See application file for complete search history.

(56) References Cited

U.S. PATENT DOCUMENTS

| | | | | | |
|---|---|---|---|---|---|
| 2,828,782 | A * | 4/1958 | Ripley | 141/216 |
| 3,380,491 | A * | 4/1968 | Rosell et al. | 141/209 |
| 3,638,832 | A * | 2/1972 | Sauber et al. | 222/16 |
| 4,397,405 | A * | 8/1983 | Batson | 222/14 |
| 4,934,565 | A * | 6/1990 | Heisey et al. | 222/22 |
| 5,131,441 | A * | 7/1992 | Simpson et al. | 141/209 |
| 5,184,309 | A | 2/1993 | Simpson et al. | |
| 5,363,889 | A * | 11/1994 | Simpson et al. | 141/208 |
| 5,365,984 | A * | 11/1994 | Simpson et al. | 141/387 |
| 5,505,234 | A | 4/1996 | Simpson et al. | |
| 5,803,136 | A * | 9/1998 | Hartsell, Jr. | 141/7 |
| 5,971,042 | A * | 10/1999 | Hartsell, Jr. | 141/198 |
| 5,992,479 | A * | 11/1999 | Simpson | 141/206 |
| 6,196,065 | B1 | 3/2001 | Henksmeier et al. | |
| 6,302,165 | B1 * | 10/2001 | Nanaji et al. | 141/59 |
| 7,566,358 | B2 * | 7/2009 | Hart et al. | 96/110 |

FOREIGN PATENT DOCUMENTS

WO 0015541 3/2000

* cited by examiner

*Primary Examiner* — Timothy L Maust
(74) *Attorney, Agent, or Firm* — Tutunjian & Bitetto, P.C.

(57) ABSTRACT

An electronically operated fuel nozzle includes a solenoid valve for dispensing fuel, an electronic board for operating the solenoid valve, electric accumulator means for electrically powering the solenoid valve and the electronic board. The solenoid valve includes an inlet pipe and an outlet pipe connected to the fuel-dispensing pipe to dispense a full flow of fuel for refueling, and a secondary channel integrated in the solenoid valve for dispensing a lower quantity of fuel for topping up, the inlet pipe and the outlet pipe are opened by an electromagnetic operating device. The secondary channel is opened by another electromagnetic operating device.

17 Claims, 3 Drawing Sheets

ELECTROMECHANICALLY OPERATED FUEL NOZZLE

TECHNICAL FIELD

The present invention relates to an electromechanically operated fuel nozzle, in particular for dispensing liquid fuel, such as petrol, diesel, kerosene and the like.

In general, the fuel nozzle according to the present invention can be used for dispensing hazardous and/or easily flammable liquids.

More specifically, the fuel nozzle according to the present invention is provided with a solenoid valve for opening and closing a fuel-dispensing pipe, or can be fitted with other equivalent electromechanical means for opening and closing a fuel-dispensing pipe.

PRIOR ART

The operation of the dispensing valve of the liquid fuel nozzles currently in common use in distributors is mechanical-manual, for example, they have a lever that can be operated by the user which mechanically opens an on/off valve in the fuel pipe and there is no electrical means for operating the aforesaid valve.

A fuel-dispensing nozzle with mechanical operation for the fuel-dispensing valve is illustrated in U.S. patent U.S. Pat. No. 5,505,234 and the nozzle is also provided with an electronic enabling circuit to permit or impede operation of the control for dispensing fuel.

The enabling circuit envisages a pressure switch and a mercury switch capable of inhibiting the operation of the control lever. The mercury switch checks the position of the nozzle and prevents fuel dispensing when the nozzle is arranged at an improper angle for refueling. The pressure switch is sensitive to the pressure in the vehicle tank being filled and interrupts the dispensing of fuel when a predetermined pressure value is reached inside the tank.

A fuel-dispensing nozzle is illustrated in U.S. patent U.S. Pat. No. 5,184,309 with electric operation of a fuel flow control valve. A pulley mechanism is envisaged to operate the flow control valve actuated by a control trigger and an electromagnetic coupling between the control pulley and the valve-opening pulley.

U.S. patent U.S. Pat. No. 5,184,309 also describes how it is possible to use an electric motor which operates the valve-opening rod by means of a mechanical coupling that transforms the movement from rotary to linear, or an electromagnetic coil which directly operates the valve-opening rod. In this last embodiment, it is also possible to have saw-tooth surfaces on the rod, oriented in such a way as to permit opening of the valve and which keep the valve open when dispensing fuel.

Overall, the construction of the fuel nozzle according to U.S. patent U.S. Pat. No. 5,184,309 is complicated, complex, costly and can be subject to defects and malfunctions.

DISCLOSURE OF THE INVENTION

It is an object of the present invention therefore to improve the construction of electromechanically operated liquid fuel-dispensing nozzles of known types.

Another object of the invention is to provide an electromechanically operated liquid fuel nozzle that is safe and reliable.

Another object of the invention is to provide an electromechanically operated liquid fuel nozzle that is handy and easy to operate.

Another object of the invention is also to provide an electromechanically operated liquid fuel nozzle that is sealed and explosion-proof.

A further object of the present invention is to provide an electromechanically operated liquid fuel nozzle that is simple and economical to manufacture.

According to one aspect of the present invention, an electromechanically operated liquid fuel nozzle is provided comprising at least one solenoid valve for dispensing fuel, an electronic board for operating the solenoid valve, electric accumulator means for electrically powering the solenoid valve and the electronic board, characterized in that the solenoid valve comprises an inlet pipe and an outlet pipe connected to the fuel-dispensing pipe to dispense a full flow of fuel for refueling, and a secondary channel integrated in the solenoid valve itself for dispensing a lower quantity of fuel for topping up.

As a result of the invention, the fuel nozzle is compact and light and it is possible to obtain high fuel flow for fast refueling and a small fuel flow for topping up with a single solenoid valve.

The dependent claims relate to preferred and advantageous embodiments of the invention.

BRIEF DESCRIPTION OF THE DRAWINGS

Further objects and advantages of the present invention will be made clearer by the following detailed description of some preferred embodiments of the present invention, provided with reference to the attached drawings, in which.

EMBODIMENTS OF THE INVENTION

Figure 1:
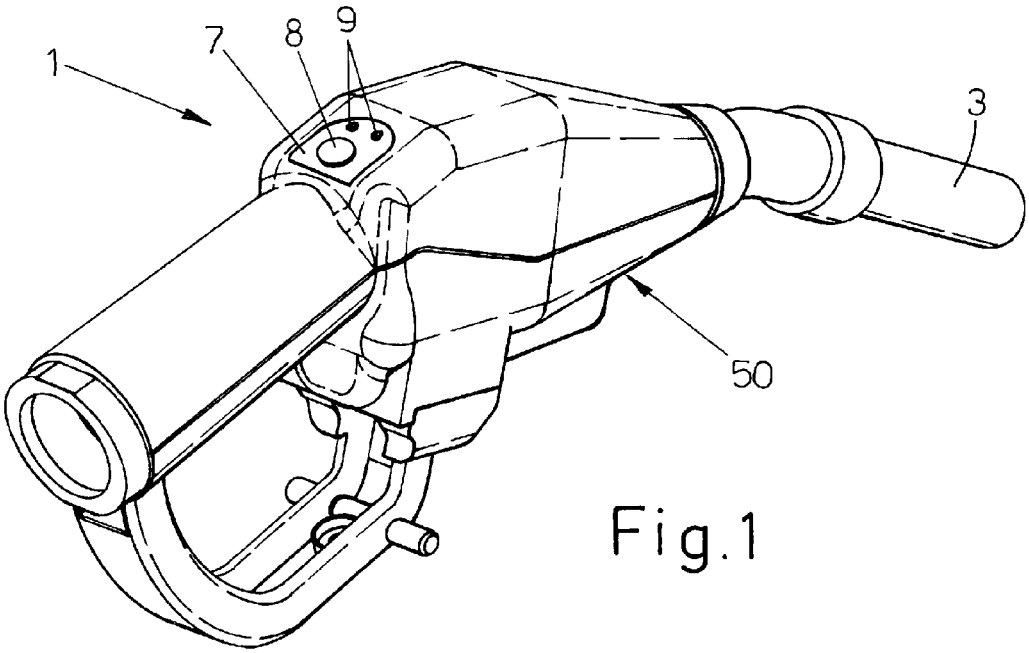
FIG. 1 is a perspective view of the fuel nozzle according to the present invention.

With reference to the drawings, 1 indicates the whole of a liquid fuel nozzle. The nozzle 1 comprises an on/off solenoid valve 2 that can open and close a pipe 3 for dispensing liquid fuel, for example petrol, diesel or kerosene.

The solenoid valve 2 also comprises a secondary channel 4 for dispensing a small quantity of fuel, for topping up, when it is necessary to dispense an exactly predefined quantity of fuel.

The solenoid valve 2 is preferably made of a flash-proof material, for example flash-proof brass, and with sealing gaskets that are resistant to fuels and/or hydrocarbons. The gaskets can be made of fluoroelastomer, for example Viton (a registered trade mark of DuPont Dow).

Two electric accumulator means 5 that can, for example, be rechargeable batteries or supercondensers, are provided for the electrical supply of the solenoid valve 2. The nozzle 1 also comprises a vapour-extraction pipe 6 and an electronic board 7 for controlling and regulating the solenoid valve 2.

The vapour-extraction pipe 6 can in turn be controlled by a solenoid valve 32 (FIG. 3), connected to the electronic board 7 to define a certain relationship between the dispensing of the fuel and the extraction of the vapours, this relationship being modifiable by appropriate programming of the electronic board 7.

The electronic board 7 also comprises an operating button 8 that can be made of metal, for example steel, to prevent damage caused by vandalism, and LEDs 9 to indicate the operating mode of the nozzle 1.

For example, the LEDs 9 may be one, or two LEDs with red and/or green lights, or other similar colours, to signal the operating conditions or blockage of the nozzle 1 to the user.

The exterior of the nozzle 1 has a shell-shaped casing 50 made of a plastic shockproof material that completely encloses and protects all the internal components; the shell 50 has an ergonomic shape and is easy to handle even by unskilled persons. The shell 50 is also liquid-tight to prevent any bleeding of fuel.

Figure 4:
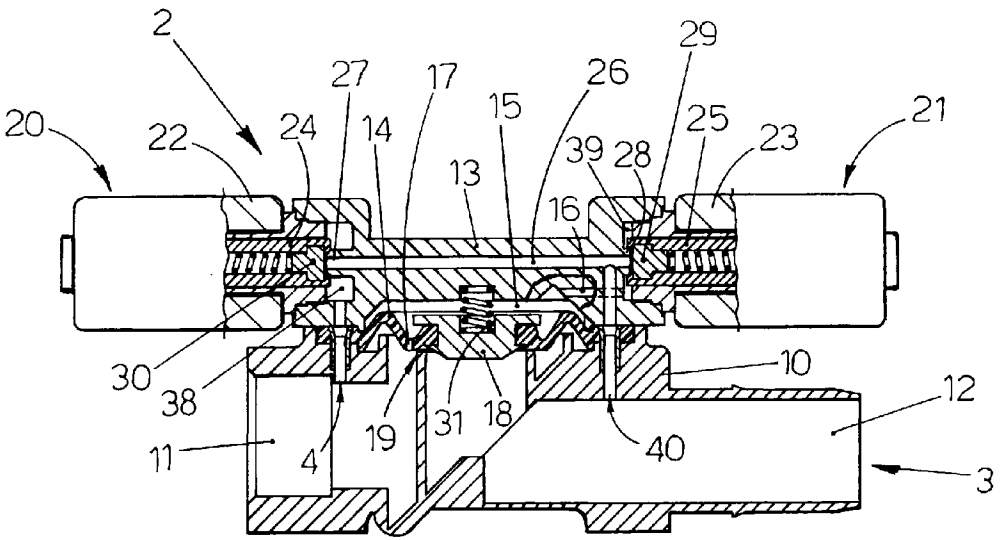
FIG. 4 is a sectional view that illustrates some details of the fuel nozzle in FIGS. 2 and 3, with the nozzle in rest conditions.
Figure 5:
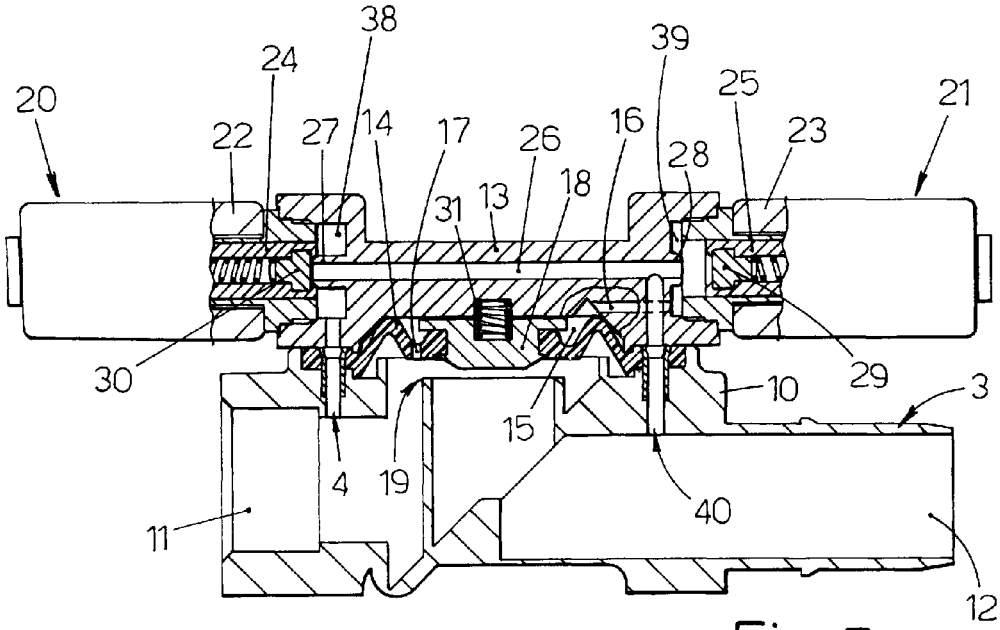
FIG. 5 is a sectional view that illustrates some details of the fuel nozzle in FIGS. 2 and 3, with the nozzle in fuel-dispensing conditions.
Figure 6:
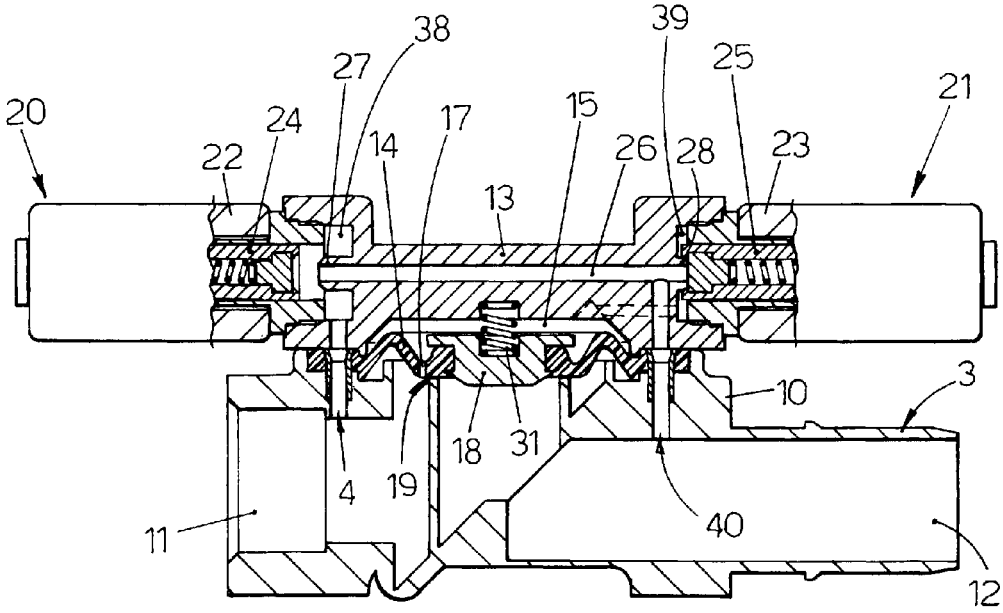
FIG. 6 is a sectional view that illustrates some details of the fuel nozzle in FIGS. 2 and 3, with the nozzle in partial fuel-dispensing conditions.

FIGS. 4-6 illustrate some sections of the solenoid valve 2, in different operating conditions: in FIG. 4, the solenoid valve 2 is closed and prevents the passage of fuel, in FIG. 5 the solenoid valve 2 is open and is in normal fuel-dispensing conditions with maximum flow, and in FIG. 6 the solenoid valve 2 is in fuel-dispensing conditions for topping up.

The solenoid valve 2 comprises a body 10 having an inlet pipe 11 and an outlet pipe 12 connected to the fuel-dispensing pipe 3.

A cover 13 is fixed on the body 10, for example, by some screws 15 which are not shown. The cover 13 is separated from the body 10 by a diaphragm 14 that in the rest position separates and closes the inlet pipe 11 from the outlet pipe 12 and has the function of an on/off valve.

Between the diaphragm 14 and the cover 13 is a piloting chamber 15 which is in communication with the inlet pipe 11 through a calibrated hole 17 found in the diaphragm 14. The diaphragm 14 also comprises a rigid part 18, envisaged to encourage tightness of the diaphragm 14 on a seat 19 realized in the body 10; when the diaphragm 14 rests on the seat 19 it hermetically closes the outlet pipe 12 and the rigid part 18 helps to support the pressure of the fuel resulting in the piloting chamber 15.

Furthermore, a spring 31 can be envisaged, acting on the rigid part 18 of the diaphragm 14 to assist the closed position of the diaphragm 14 on the seat 19. Also found on the cover 13 are a first and a second electromagnetic operating device 20 and 21 which, for example, can be realized by means of electric coils 22, 23 and anchors made of a ferromagnetic material 24, 25.

The electromagnetic operating devices 20 and 21 are inserted tight in respective chambers 38, 39 obtained in the cover 13. For example, the electromagnetic operating devices 20 and 21 can be screwed tight into suitable threaded seats obtained in the cover 13. The chamber 38 is in communication with the inlet pipe 11 by means of the secondary channel 4.

By means of the anchors 24, 25, the electromagnetic operating devices 20 and 21 make it possible to open and close two ends 27, 28 of a connection pipe 26 that puts the chambers 38 and 39 into communication with each other and which can also be found in the cover 13. In particular, the first end 27 of the connection pipe 26 is found in the chamber 38 and the second end 28 is found in the chamber 39.

The pipe 26 is also connected to the outlet pipe 12 by means of a discharge channel 40. In order to reduce dimensions, the electromagnetic coils 22, 23 and the anchors 24, 25 have their own respective axis of rotation and movement parallel to the inlet and outlet pipes 11, 12. In accordance with what is illustrated in the figures, in particular in FIGS. 3-6, the electromagnetic coils 22, 23 and the anchors 24, 25 are horizontal as are the inlet and outlet pipes 11, 12, and in general like the pipe 3 for dispensing the fuel. A reduction in the height of the solenoid valve 2, which can easily be inserted in the shell 50, is obtained with this configuration.

The piloting chamber 15 is connected to the chamber 39 in which the end 28 can be found by means of a further communication channel 16, while the end 28 of this chamber 39 can be closed by the anchor 25 of the electromagnetic operating device 21.

In order to improve tightness when they are closed, the ends 27, 28 are prominent compared with the inner surface of the chambers 38 and 39 and the operating devices 20, 21 have sealing surfaces 29, 30, for example in fuel-proof rubber.

When the solenoid valve 2 is closed (FIG. 4), both electromagnetic operating devices 20 and 21 are deactivated, the fluid, or the fuel, under pressure in the inlet pipe 11 passes into the piloting chamber 15 through the calibrated hole 17 in the diaphragm 14.

The force developed by the pressure of the fuel in the chamber 15 and the force of any spring 31, acting on the top part of the diaphragm 14, are greater than the force developed by the pressure of the fluid acting on the bottom part of the diaphragm 14, as it acts on a bottom annular area that is smaller than the total top area of the diaphragm 14.

Therefore, the diaphragm 14 positions itself to rest on the seat 19 and, by closing it, divides the inlet pipe 11 from the outlet pipe 12.

When the solenoid valve 2 is required to dispense the maximum fuel flow for refueling, the electromagnetic operating device 21 is activated by means of the button 8 on the electronic board 7.

The second electromagnetic operating device 21 moves the anchor 25 and puts the piloting chamber 15 into communication with the outlet pipe 12 through the connection pipe 26 and the discharge channel 40, giving rise to a pressure drop in the chamber 15 which in turn raises the diaphragm 14, putting the inlet pipe 11 into communication with the outlet pipe 12.

Therefore, the second electromagnetic operating device 21 operates the diaphragm 14 in an indirect and servo-controlled manner, in such a way as to open and close the full fuel dispensing pipe 3.

When it is necessary to top up the fuel, i.e. when it is necessary to dispense a small quantity of fuel, the second electromagnetic operating device 21 is deactivated, the pressure in the piloting chamber 15 increases once more and the diaphragm 14 returns to the closed position on the seat 19.

At the same time, the first electromagnetic operating device 20 is activated and opens the end 27 of the connection pipe 26 which, in turn, puts the inlet pipe 11 into communication with the outlet pipe 12 through the second channel 4, the connection pipe 26 and the discharge channel 40, thereby permitting the dispensing of a small flow of fuel for the top-up.

Then, the first electromagnetic operating device 20 opens and closes, in a direct manner, the secondary, channel 4 for topping up the fuel.

The top-up flow is determined by the passage sections of the abovementioned secondary channel 4, connection pipe 26 and discharge channel 40 which are appropriately dimensioned in such a way as to obtain the desired flow (about 3 liters per minute) with the delivery pressures normally used in fuel distributors (about 1.5 bar).

When dispensing the top-up flow, the pressure in the piloting chamber 15 remains high, keeping the diaphragm 14 in the closed position on the seat 19. This is due to the fact that, as the top-up flow is relatively small, the pressure in the inlet pipe 11 does not drop in a significant manner and, as a result, the pressure in the piloting chamber 15 remains substantially unchanged.

In accordance with an alternative embodiment not illustrated, there is no first electromagnetic operating device 20 and the end 27 of the connection pipe 26 is opened or closed by means of a direct mechanically operated valve.

It should be noted that the solenoid valve 2 is also very compact as it includes, already incorporated, the channels for full dispensing with a high fuel flow and for topping up with a low fuel flow. Furthermore, the electromagnetic operating devices 20, 21 take up little space and, in particular, have electromagnetic coils, 22, 23 and anchors 24, 25 with the axis parallel to the inlet and outlet pipes 11, 12.

Figure 2:
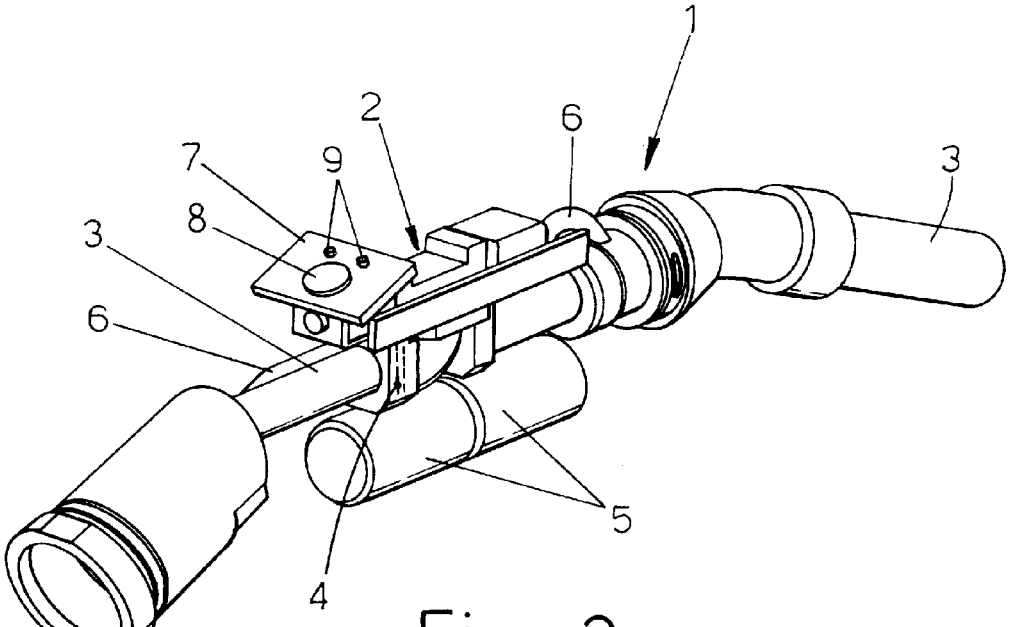
FIG. 2 is a perspective view of internal details of the fuel nozzle in FIG. 1.
Figure 3:
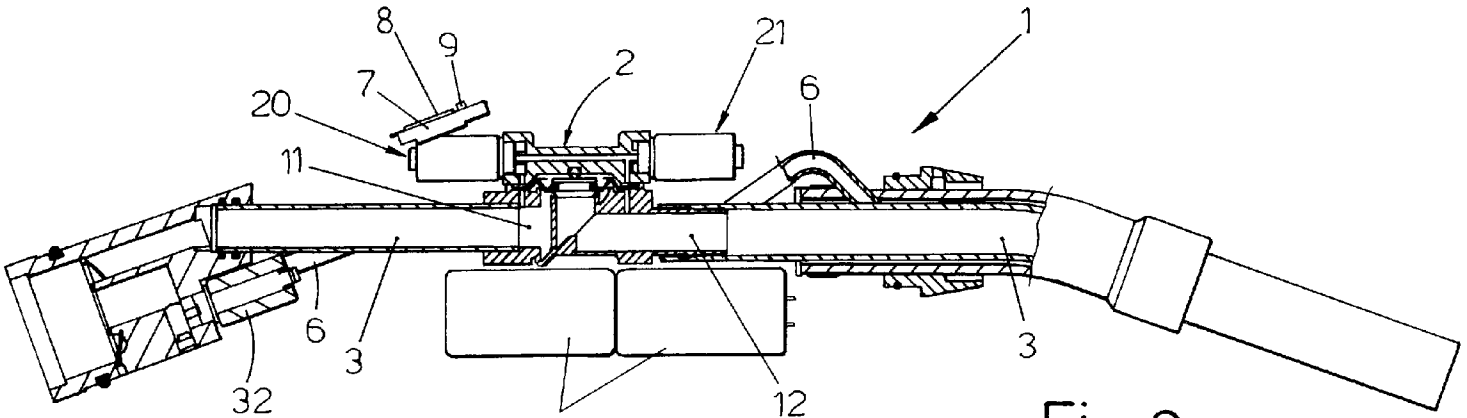
FIG. 3 is a view, partly in section, of some details of the fuel nozzle in FIG. 2.

As is evident from FIGS. 1-3 in particular, the solenoid valve 2 is therefore just a little higher than the above mentioned inlet and outlet pipes 11, 12 and, therefore, it can be inserted in an optimum manner into the shell 50 of the nozzle 1, contributing to keeping the dimensions small.

The nozzle 1 can be realized in at least two main versions: for refueling cars or for trucks. By way of example it can be indicated that, with a fuel delivery pressure of 1.5 bar, the flow is about 45 liters per minute for the car version of the nozzle, about 80-90 liters per minute for the truck version of the nozzle, and about 3 liters per minute for the top-up flow.

In use, the nozzle 1 is initially placed in an appropriate nozzle-holder seat on the distributor which also provides the maintenance charge of the electrical accumulator means 5. When refueling is to be carried out, the user grips the nozzle 1 and extracts it; the switching of a special micro-switch on the nozzle-holder informs the distributor of the need to start the fuel-dispensing pump.

At the same time, the electronic board 7 of the nozzle 1 is activated and resets the safety sensors with which the nozzle is fitted.

As a consequence, an LED 9 lights up, red for example, indicating that the nozzle 1 is activated, but fuel-dispensing is not enabled: if the dispensing operation button 8 is pressed by mistake, nothing will happen and no fuel will be dispensed.

When the user inserts the nozzle 1 into the tank of the vehicle to fill, the safety sensors supply the respective enabling signals for dispensing and, as a consequence, the signaling LED 9 changes colour, becoming green for example, or a second green LED 9 lights up, and the first LED goes off, indicating that the nozzle 1 is ready for dispensing fuel.

Fuel dispensing can therefore be activated by means of a firm, but temporary, pressure on the button 8, which can subsequently be released.

In another version for self-service distribution systems, fuel dispensing is activated by continuous pressure on the button 8, for safety reasons and according to any safety regulations in force. These and other functions are in any case modifiable and adjustable with the simple new programming of the electronic board 7.

Fuel dispensing continues automatically until one of the safety sensors trips, for example the overfill sensor if the vehicle tank is completely full, or up to the quantity previously programmed and then fuel dispensing stops without the need for any further action.

Naturally, fuel dispensing would also have stopped if the nozzle angle had changed, if the nozzle had fallen for example, or because the dispensing time is too long.

The maximum dispensing time, which can be reset for about two minutes, can also be modified by reprogramming the electronic board 7.

If, following an interruption in dispensing due to the fuel level rising in the vehicle's tank, the fuel level should drop again for any reason—for example because of a reduction in the foam that might have formed during tank refueling—the LED 9 turns green again, indicating that the nozzle is enabled once again for a top up, with the same procedures described previously.

The operations to carry out for the user are very simple: release the nozzle from the nozzle-holder, insert the nozzle into the tank inlet, press the dispensing button for a moment—or continuously if requested—, wait until refueling is complete, replace the nozzle.

It is therefore evident that the use of the nozzle according to the invention is simple and convenient. Compared with nozzles of the traditional type, the bleeding of fuel and the inconvenience of "blocked dispensing"—by means of the traditional little blocking hook on the control lever—have been solved and eliminated while, at the same time, reducing the complexity of construction and therefore the cost of the nozzle. It is also possible to easily integrate different safety devices in order to obtain high operating safety while maintaining the nozzle's simplicity of construction.

As a result of the special design of the solenoid valve 2, which includes already integrated in the inside thereof the pipes and channels for full dispensing with a high fuel flow and topping up with a low fuel flow and by means of the electromagnetic operating devices 20 and 21 arranged with their axis parallel to the inlet and outlet pipes 11, and 12, the nozzle 1 is compact and takes up little space.

The nozzle according to the invention is therefore easy to replace and can be integrated in already existing fuel-distribution systems and in fact shares many of the accessories with these systems.

Naturally, the present invention is not limited to the executive embodiments illustrated and described, but includes all the appropriate variants and modifications for achieving the same result and, therefore, falling within the vaster scope of the inventive concept, substantially as described, illustrated and as claimed.

In the claims, the references provided between parentheses are purely indicative and do not limit the scope of protection of the claims.

The invention claimed is:

1. Electromechanically operated fuel nozzle (1) comprising at least one solenoid valve (2) for dispensing fuel, an electronic board (7) for operating the solenoid valve (2), electric accumulator means (5) for electrically powering the solenoid valve (2) and the electronic board (7), the solenoid valve (2) comprising an inlet pipe (11) and an outlet pipe (12) connected to the fuel-dispensing pipe (3) to dispense a full flow of fuel for refueling a vehicle, and a secondary channel (4) integrated in the solenoid valve (2) for dispensing a lower quantity of fuel for topping up.

2. Fuel nozzle according to claim 1, in which the solenoid valve (2) comprises a body (10) having the inlet pipe (11) and the outlet pipe (12) connected to the fuel-dispensing pipe (3).

3. Fuel nozzle according to claim 2, in which the solenoid valve (2) comprises a cover (13) fixed to the body (10), the cover (13) being separated from the body (10) by a diaphragm (14) that in the rest position separates and closes the inlet pipe (11) from the outlet pipe (12) and having the function of an on/off valve.

4. Fuel nozzle according to claim 3, in which the solenoid valve (2) comprises a piloting chamber (15) placed between the diaphragm (14) and the cover (13), the piloting chamber (15) being in communication with the inlet pipe (11) through a calibrated hole (17) found in the diaphragm (14).

5. Fuel nozzle according to claim 3, in which the cover (13) comprises a first and a second electromagnetic operating device (20, 21), realized for example by means of electric coils (22, 23) and anchors made of a ferromagnetic material (24, 25), each of the electromagnetic operating devices (20, 21) being envisaged for respectively opening the secondary channel (4) for topping up and the pipe (3) for full fuel dispensing.

6. Fuel nozzle according to claim 5, in which the electromagnetic operating devices (20, 21) have the electromagnetic coils (22, 23) and the anchors (24, 25) with their own respective axis of rotation and movement parallel to the inlet and outlet pipes (11, 12) and to the fuel-dispensing pipe (3).

7. Fuel nozzle according to claim 5, in which the second electromagnetic operating device (21) operates the diaphragm (14) in an indirect and servo-controlled manner, by means of a communication channel (16) connected to a channel (39) with which the second electromagnetic operating device (21) interfaces, the chamber (39) is in turn put into connection with the outlet pipe (12) by the second electromagnetic operating device (21) in such a way as to open and close the pipe (3) for full fuel dispensing.

8. Fuel nozzle according to claim 5, in which the first electromagnetic operating device (20) opens and closes, in a direct manner, the secondary channel (4) for topping up the fuel.

9. Fuel nozzle according to claim 5, in which the cover (13) comprises a connection pipe (26), the ends (27, 28) of which are opened or closed by the first and second electromagnetic operating devices (20, 21).

10. Fuel nozzle according to claim 1, in which the secondary channel (4) for topping up the fuel is opened or closed by a direct mechanically operating valve.

11. Fuel nozzle according to claim 1, in which the solenoid valve (2) is operated by a control and adjustment electronic board (7).

12. Fuel nozzle according to claim 1, in which the solenoid valve (2) is powered by electric accumulator means (5) including rechargeable batteries or supercondensers.

13. Fuel nozzle according to claim 1, externally comprising a shell-shaped casing (50) made of a plastic shockproof material that completely encloses and protects all the internal components, the shell (50) being liquid-tight to prevent any bleeding of fuel.

14. Fuel nozzle according to claim 1, comprising a vapour-extraction pipe (6).

15. Fuel nozzle according to claim 14, wherein the vapour-extraction pipe (6) is controlled by a solenoid valve (32) connected to the electronic board (7).

16. Fuel nozzle according to claim 15, in which the solenoid valve (32) defines a certain relationship between the dispensing of the fuel and the extraction of the vapours, this relationship being modifiable by programming the electronic board (7).

17. Fuel nozzle according to claim 1, in which the solenoid valve (2) is made of a flash-proof material and with sealing gaskets that are resistant to fuels and/or hydrocarbons.

* * * * *